US005842454A

United States Patent [19]

Miwa et al.

[11] Patent Number: 5,842,454

[45] Date of Patent: Dec. 1, 1998

[54] FUEL PUMP CONTROL WITH CONTROL MODE SWITCHING BETWEEN BEFORE AND AFTER ENGINE STARTING

[75] Inventors: Makoto Miwa; Naoki Yoshiume, both of Kariya; Kiyotoshi Oi, Toyohashi; Kazuji Minagawa, Tokoname; Shigeru Takeuchi, Gamagori; Akira Ando, Nukata, all of Japan

[73] Assignee: Denso Corporation, Kariya, Japan

[21] Appl. No.: 740,141

[22] Filed: Oct. 22, 1996

[30] Foreign Application Priority Data

Nov. 28, 1995 [JP] Japan ..... 7-308731

[51] Int. Cl.[6] ..... F02M 37/04

[52] U.S. Cl. ..... 123/497; 123/179.17

[58] Field of Search ..... 123/497, 179.17, 123/456, 357

[56] References Cited

U.S. PATENT DOCUMENTS

| | | | |
|---|---|---|---|
| 4,083,345 | 4/1978 | Davis | 123/179.17 |
| 4,577,604 | 3/1986 | Hara | 123/497 |
| 5,092,302 | 3/1992 | Mohan | 123/497 |
| 5,293,299 | 3/1994 | Iwabuchi | 123/497 |
| 5,379,741 | 1/1995 | Matysiewicz | 123/497 |
| 5,394,844 | 3/1995 | Akimoto | 123/497 |
| 5,406,922 | 4/1995 | Tuckey | 123/497 |
| 5,425,342 | 6/1995 | Ariga | 123/179.17 |
| 5,507,266 | 4/1996 | Wright | 123/497 |
| 5,555,872 | 9/1996 | Takeuchi | 123/497 |

FOREIGN PATENT DOCUMENTS

A-57-68529 4/1982 Japan .

*Primary Examiner*—Carl S. Miller
*Attorney, Agent, or Firm*—Nixon & Vanderhye, P.C.

[57] ABSTRACT

In a fuel pump control, until a rotational speed of an electrically-driven fuel pump rises to a predetermined speed, an electric current supplied to the fuel pump at an engine starting is increased higher than that normally supplied after engine starting thereby causing fast build-up of the fuel pressure. After the fuel pump reaches the predetermined speed, the electric current is decreased to a normal after-start current thereby suppressing a fuel pressure overshoot and resulting overrich mixture. Alternatively, a fuel pump speed is raised by the voltage control first at an engine starting operation, while switching the voltage control to the current control intermittently to detect the voltage applied to the fuel pump. When the detected voltage reaches a first predetermined voltage, the fuel pump speed is controlled exclusively by the current control.

11 Claims, 6 Drawing Sheets

FIG. 4A
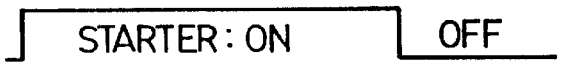
FIG. 4B
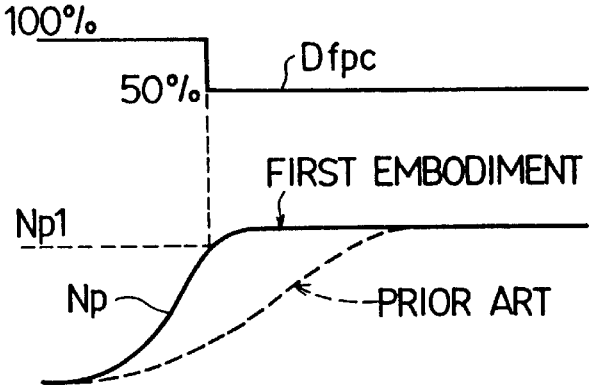
FIG. 4C
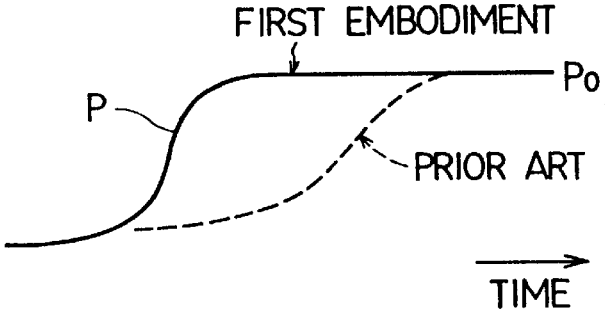
FIG. 4D
FIG. 5A
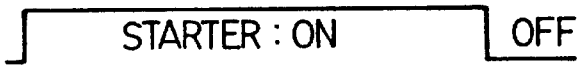
FIG. 5B
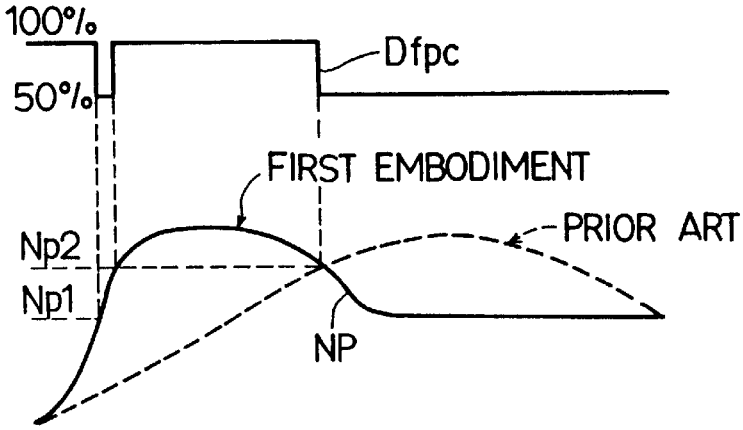
FIG. 5C
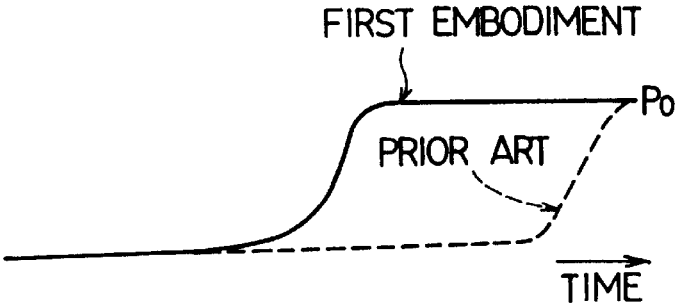
FIG. 5D

FUEL PRESSURE CONTROL

201
START MODE ?
NO
YES
202
TIMER CFPV>0 ?
NO
YES
203
TIMER CFPV←CFPV-1
208
TIMER CFPI←CFPI-1
204
CFPV>0?
NO
YES
209
CFPI>0?
NO
YES
206
CFPI←CFPIO
CURRENT CONTROL
207
205
VOLTAGE CONTROL
211
READ Vfp
212
CALCULATE Qeng
213
Vfp1←f3(Qeng, Po)
Vfp2←f4(Qeng, Po)
214
<Vfp1<Vfp<Vfp2?
YES
NO
215
CFPV←f5(Vfp, Vfpo)
210
CURRENT CONTROL
216
VOLTAGE CONTROL
217
CLEAR START MODE FLAG
NORMAL CURRENT CONTROL
218
RETURN

STARTER : ON
OFF
CFPV
VOLTAGE CONTROL
CURRENT CONTROL

VB

Vfpo
Vfp
SECOND EMBODIMENT

TIME

FUEL PUMP CONTROL WITH CONTROL MODE SWITCHING BETWEEN BEFORE AND AFTER ENGINE STARTING

BACKGROUND OF THE INVENTION

1. Field of the Invention

The present invention relates to a fuel pump control for an engine and, more particularly, to a fuel pump control which switches control characteristics between before and after engine starting.

2. Description of Related Art

In a fuel pump control for an internal combustion engine having fuel injectors, it is known by JP-A 57-68529 to change electric currents supplied to an electric fuel pump in accordance with three engine operating conditions, i.e., engine starting, engine idling and normal running. In the engine starting period in which a fast rise in fuel pressure fuel is desired, a higher electric current is supplied to the pump than in the other engine operating conditions thereby to increase the rotational speed of the engine and increase the fuel pressure.

This higher electric current is likely to cause the fuel pressure to overshoot above a normal fuel pressure and cause the air-fuel mixture supplied to the engine to become too rich in fuel temporarily. The overrich mixture will degrade the engine starting operation and exhaust emissions. These adverse effects resulting from the fuel pressure overshoot and the resulting overrich mixture become more noticeable in a no return fuel supply system which has no fuel return passage for returning excess fuel from the fuel injectors to a fuel tank, because the increased fuel pressure in such a no return system does not decrease unless the fuel injectors supply the excess fuel to the engine.

SUMMARY OF THE INVENTION

It is therefore an object of the present invention to provide a fuel pump control which raises fuel pressure as fast as possible at an engine starting, without causing an overshoot of fuel pressure or degrading exhaust emissions.

According to a first aspect of the present invention, until a rotational speed of an electrically-driven fuel pump rises to a first predetermined speed, an electric current supplied to the fuel pump at an engine starting is increased higher than that normally supplied after engine starting completion thereby causing fast build-up of the fuel pressure. After the fuel pump reaches the predetermined speed, the electric current is decreased to a normal after-start current thereby suppressing any fuel pressure overshoot and resulting overrich mixture and improving engine starting and exhaust emissions.

Where compressible gas such as air or fuel vapor exists a fuel supply system, the load on the fuel pump is low and the fuel pump speed will continue to rise even after the electric current is decreased to the normal after-start current. The compressible gas will result in an incorrect amount of fuel supply from fuel injectors to the engine and it should be purged from the fuel supply system as quickly as possible. Therefore, preferably, the electric current to the fuel pump is increased again higher than the normal after-start current, when the pump rotational speed rises above a second predetermined speed higher than the first predetermined speed. This increased electric current raises the pump rotational speed and the fuel pressure so that the compressible gas is purged with fuel through the injector at soon as possible after engine starting.

According to a second aspect of the present invention, a fuel pump is controlled by a combination of a voltage control effective for quick fuel pressure build-up and a current control effective for regulating fuel pressure without a fuel pressure sensor. That is, fuel pump speed is raised by the voltage control first at an engine starting operation, while switching the voltage control to the current control intermittently to detect the voltage applied to the fuel pump. When the detected voltage reaches a first predetermined voltage, the fuel pump speed is controlled exclusively by the current control.

Preferably, the current control is switched back to the voltage control again when the detected voltage rises again above a second predetermined voltage higher than the first predetermined voltage during the current control. This control effectively purges the compressible gas in the fuel supply system as soon as possible after engine starting.

BRIEF DESCRIPTION OF THE DRAWINGS

Additional objects, features and advantages of the present invention will become more apparent from the following detailed description when read with reference to the accompanying drawings, in which:

FIGS. 4A–4D and FIGS. 5A–5D are time charts illustrating operational modes of the first embodiment;

DETAILED DESCRIPTION OF PRESENTLY PREFERRED EMBODIMENTS

The present invention will be described in detail with reference to two presently preferred embodiments.

(First Embodiment)

Figure 1:
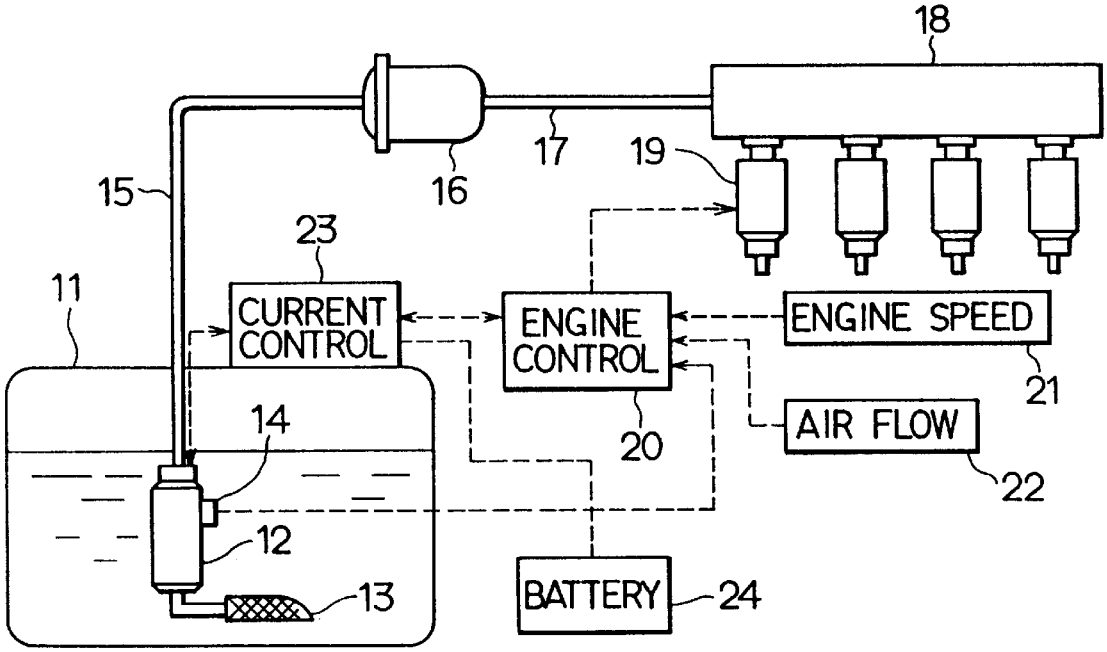
FIG. 1 is a schematic view illustrating a fuel supply system according to a first embodiment of the present invention.

In a fuel supply system according to the first embodiment illustrated in FIG. 1, a fuel tank 11 contains therein an electrically-driven fuel pump 12 and a fuel filter 13 attached to the inlet port of the fuel pump 12. The fuel pump 12 uses a D.C. motor (not shown) and has a pump rotation sensor 14 which detects a rotational speed of the fuel pump 12. Fuel pipes 15, 17, a fuel filter 16 and fuel delivery pipe 18 connects the fuel pump 12 to fuel injectors 19. The fuel injectors 19 are in fluid communication with the delivery pipe and mounted on an internal combustion engine (not shown) so that fuel pumped up and discharged from the fuel pump 12 is stored in the delivery pipe 18 and injected into the engine through the fuel injectors 19. This fuel passage is a no return type which has no return line for returning excess fuel from the delivery pipe 18 to the fuel tank 11.

For the electric control of the fuel supply system, an engine control circuit 20 and a constant current control circuit 23 are connected. The engine control circuit 20 receives an engine rotation speed signal from an engine speed sensor 21, an air flow amount signal from an air flow sensor 22, a pump speed signal from the pump rotation speed sensor 14 and other information from various sensors (not shown) and calculates ignition timings, fuel injection amounts, target fuel pressures and the like in response to the received sensor signals. Thus, the control circuit 20 electrically drives the fuel injectors 19 which inject into the engine the pressurized fuel in the delivery pipe 18 in proportion to the opening duration thereof. The current control circuit 23, controlled by a duty ratio signal from the engine control circuit 20, is so constructed as to apply a battery voltage of a storage battery 24 to the fuel pump 12 in proportion to the duty ratio signal. That is, the current control circuit 23 converts the received duty ratio signal into a target current and feedback-controls the electric current to the fuel pump 12 to the target current.

Figure 2:
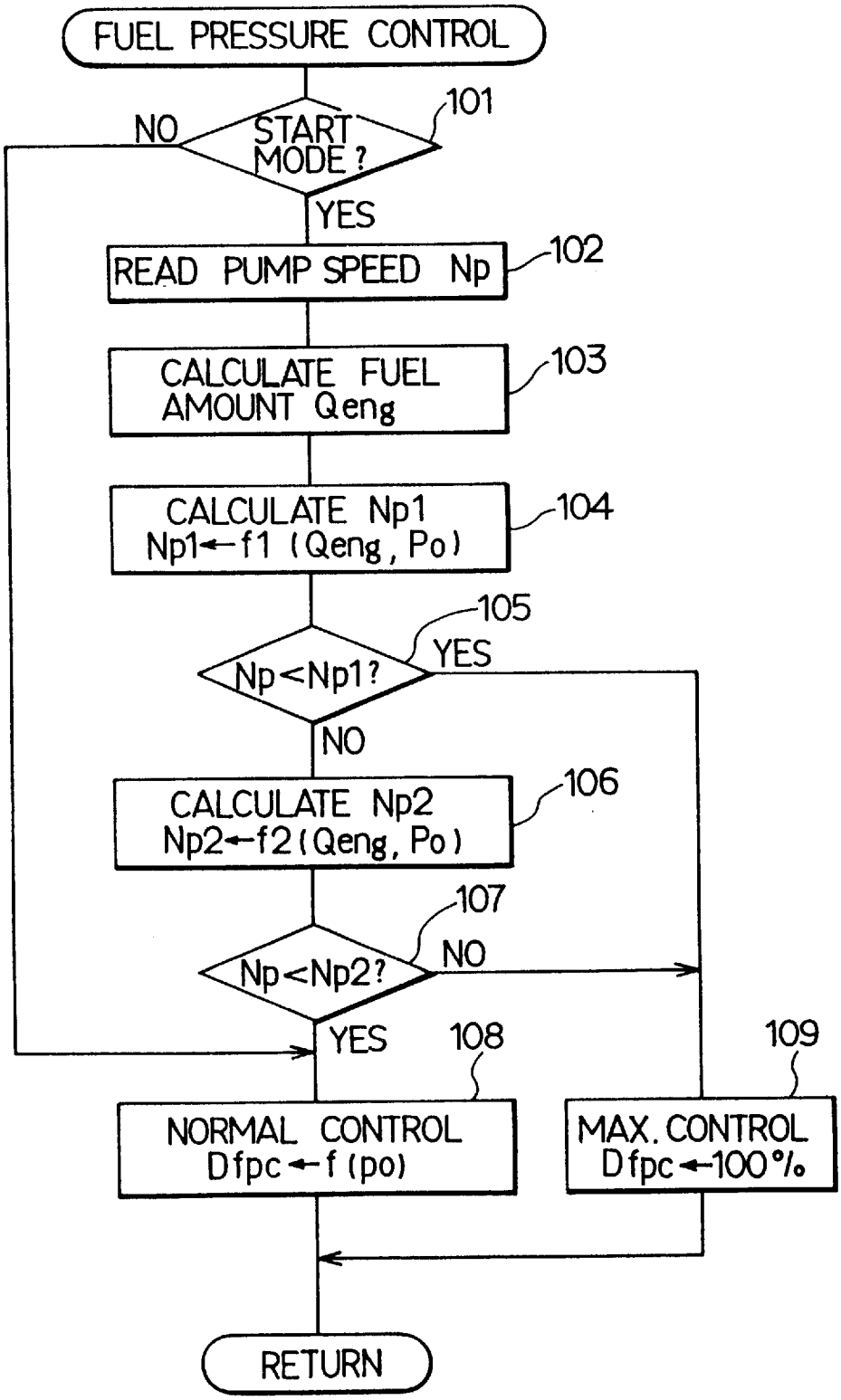
FIG. 2 is a flowchart illustrating a fuel pressure control routine performed in the first embodiment.

The engine control circuit 20 uses a microcomputer and is programmed to perform the fuel pressure control routine shown in FIG. 2. The control routine starts after the engine ignition switch (not shown) is turned on and repeats at every predetermined time interval or at every angular rotation of the engine.

The control routine determines at a step 101 whether the engine is in a starting mode, i.e., a starter motor (not shown) is driven or the engine rotational speed is below 500 r.p.m. for instance. With a YES determination, a step 102 reads the pump speed Np detected by the pump speed sensor 14 and then a step 103 calculates a fuel consumption flow amount Qeng required by the engine from the following equation as a function of fuel injection duration Ti, engine rotation speed Ne and a conversion constant $\alpha$.

$$Qeng=Ti\times Ne\times\alpha$$

Figure 3:
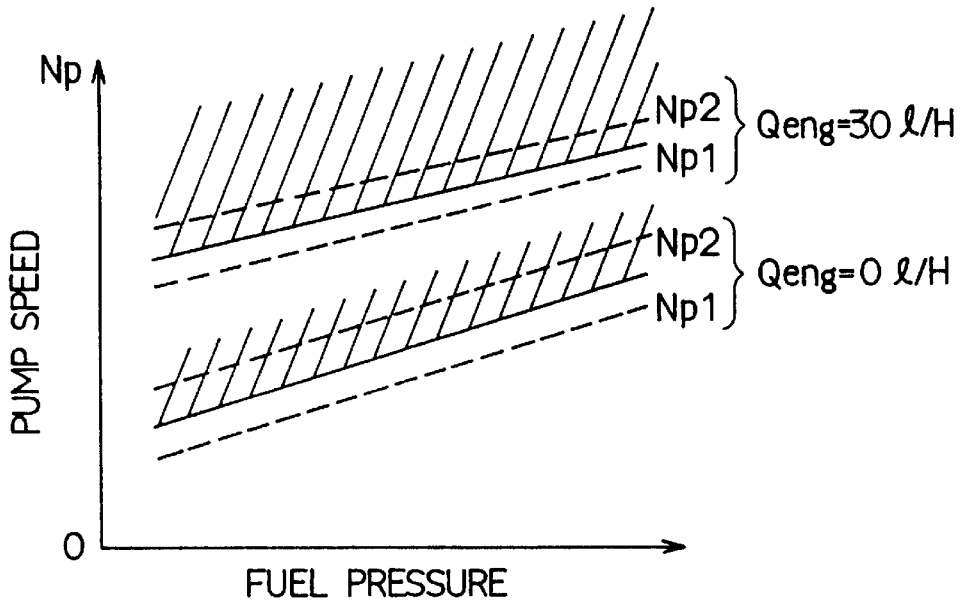
FIG. 3 is a graph illustrating the relationship between fuel pressure and fuel pump speed in the first embodiment.

A step 104 calculates from mapped data stored in a ROM (not shown) of the control circuit 20, i.e., a target fuel pressure Po and a fuel consumption flow amount Qeng as two speed-determining parameters, a first predetermined pump rotation speed Np1 as Np1=f1 (Qeng, Po). The pump speed Np1 is set closely to a maximum of a region where fuel can be supplied normally. An example of the mapped data is illustrated in FIG. 3 and the target fuel pressure Po is defined as a target of the normal fuel pressure to be attained by the normal current control after completion of engine starting. The target fuel pressure Po is set to about 300 kPa for normal engine starting operation and to about 400 kPa for a special engine starting operation such as hot engine restarting.

A step 105 compares the actual fuel pump speed Np read in step 102 with the first predetermined speed Np1. With the determination of Np<Np1, step 109 sets a duty ratio Dfpc to 100% thereby to cause the constant current control circuit 23 to drive the fuel pump 12 by a maximum current. This results in a fast rise of the fuel pump rotation speed.

After the pump speed Np rises above the first predetermined speed Np1 (Np>Np1), a step 106 follows the step 105 and calculates a second predetermined pump speed Np2 from mapped data of Po and Qeng as Np2=f2 (Qeng, Po) in the similar manner as the first predetermined speed Np1. As illustrated in FIG. 3, the second predetermined speed Np2 is set higher than the first predetermined speed Np1 and is in a range (hatched) which is above the maximum pump speed so that more fuel can be supplied in excess of the fuel amount required by the engine. In the case that a compressive gas such as the air or fuel vapor remains in the fuel pipes 15, 17 after the fuel pump speed Np has attained the first predetermined speed Np1, the actual pump speed Np continues to rise above Np1 because there is less of a load on the fuel pump 12. The second predetermined speed Np2 is used to detect this condition at a step 107 where the actual pump speed Np is compared with the second predetermined speed Np2.

With the determination of Np<Np2 at the step 107, a step 108 sets the duty ratio Dfpc as a function of the target fuel pressure Po and the current control circuit 23 controls the current to the fuel pump 12 to attain the target fuel pressure Po.

On the other hand, with the determination of Np>Np2 at the step 107 indicating existence of the air or vapor in the pipes 15, 17, a step 109 raises the duty ratio Dfpc to 100% again so that the current control circuit 23 drives the pump 12 by a maximum current. Thus, the fuel pump 12 discharges more fuel into the fuel pipes 15, 17 and the delivery pipe 18 so that the fuel pressure in the fuel system attains the target fuel pressure Po at the earliest time.

As the fuel pipes 15, 17 and the delivery pipe 18 is filled with fuel, the fuel pump 12 is subjected to a greater load which causes a decrease in the pump speed Np. After the pump speed Np decreases below the second predetermined speed Np2, the step 108 follows and the normal control is performed to attain the target fuel pressure Po. It is to be noted that, when the step 101 determines No (engine after-start condition), the step 108 continues to perform the normal fuel pump control described above.

Operations of the first embodiment are illustrated in FIGS. 4A–4D and FIGS. 5A–5D in correspondence to two cases where the actual pump speed Np does not rise and rises above the second predetermined speed, respectively.

Where the pump speed Np does not exceed the second predetermined speed Np2, immediately after the starter motor is turned on for engine starting (FIG. 4A), the duty ratio Dfpc (FIG. 4B) is set to 100% thereby to raise the pump speed Np (FIG. 4C) quickly to the first predetermined speed Np1 and hence raise the fuel pressure P (FIG. 4D) to the target pressure Po. At the time the pump speed Np reaches the first predetermined speed Np1, the duty ratio Dfpc is decreased to the value (e.g., 50%) for maintaining the fuel pump speed and the target fuel pressure Po. This control not only provides a faster fuel pressure build-up than in the conventional case illustrated by dotted lines but also suppresses overshoot of the fuel pressure and the resulting overrich air/fuel mixture supply, thereby improving engine starting ability and exhaust emissions.

Where the pump speed Np exceeds the second predetermined speed Np2 because of the compressive gas remaining in the fuel system, even after the pump speed Np (FIG. 5C) rises to the first predetermined speed after the engine starting (FIG. 5A) and the duty ratio Dfpc (FIG. 5B) is decreased from 100% to a smaller value (e.g., 50%), the pump speed Np continues to rise above Np1 because the compressive gas in the fuel lowers the load to the fuel pump 12. At the time the pump speed Np rises above the second predetermined speed Np2, the duty ratio is increased again to 100% to drive the fuel pump 12 by the maximum current. As a result, the pump speed Np rises further and, by discharging more fuel into the fuel pipes 15, 17 and the delivery pipe 18, raises the fuel pressure (FIG. 5D) to the target pressure Po. As the fuel presure increases, the pump speed Np decreases. At the time the pump speed Np decreases below the second predetermined speed Np2, the duty ratio Dfpc is decreased from 100% to the smaller value thereby to suppress the overshoot of fuel pressure and improve the engine starting and exhaust emissions.

In the first embodiment, in place of the current control which increases the duty ratio Dfpc to a maximum (100%) while Np is lower than Np1 or higher than Np2, a voltage control may be adopted thereby to apply the battery voltage VB (12V) to the fuel pump. In this instance, a higher electric current can be supplied to the fuel pump, resulting in the faster fuel pressure build-up.

(Second Embodiment)

Figure 6:
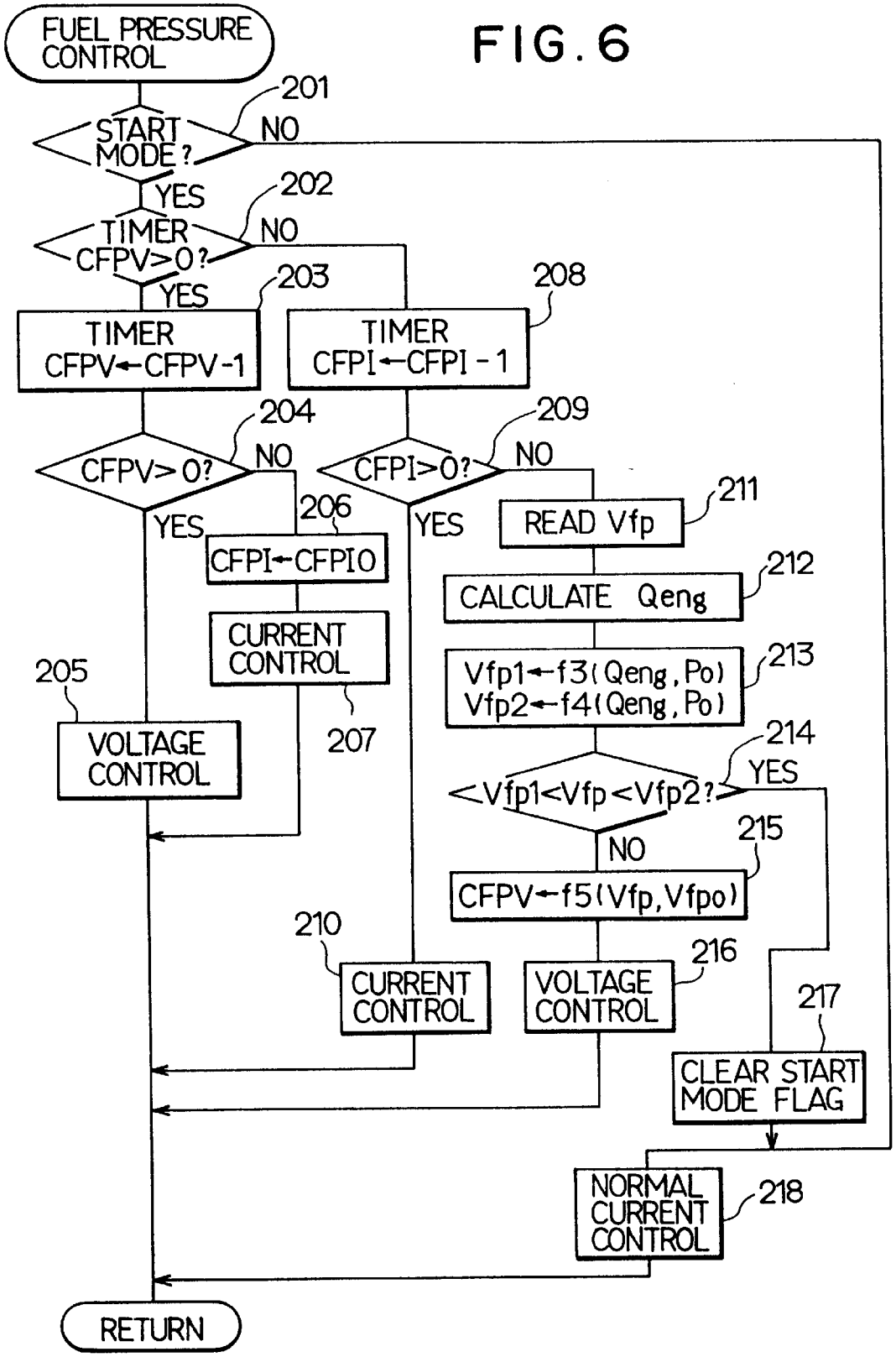
FIG. 6 is a flowchart illustrating a fuel pressure control routine performed in a second embodiment of the present invention.

In the second embodiment illustrated in FIG. 6, the engine control circuit 20 (FIG. 1) performs the voltage control at the time of engine starting and the current control after the engine starting. Further, the engine control circuit 20 performs the current control intermittently during the voltage control.

At first, a step 201 determines whether the engine is in the starting mode by a start mode flag. This start mode flag is used exclusively for the fuel pump control and may be set when the starter motor is driven or the engine speed is below 500 r.p.m. With the setting of the start mode flag, a voltage control duration timer value CFPV is set with an initial value CFPV0 (e.g., 50 ms).

With the determination (YES) of engine starting at the step 201, a step 202 determines whether it is in the course of the voltage control by comparing the timer value CFPV with 0. With CFPV>0, a step 203 decreases the timer value CFPV and step 204 compares it with 0. With CFPV>0, a step 205 continues the voltage control by which a battery voltage VB (e.g. 12V) or a slightly lower voltage is applied to the fuel pump 12 thereby to raise the pump speed and the resulting fuel pressure quickly.

During the voltage control, the step 203 repeats its decreasing operation until the step 204 determines that the timer value CFPV has decreased to 0. Thereafter, a step 207 sets an intial value CFPI0 as a current control duration timer value CFPI. The current control is performed to detect the rotation speed of the fuel pump 12 from a terminal voltage Vfp of the fuel pump 12. Therefore, the intial value CFPI0 is set to correspond to a time duration required for the fuel pump to stabilize its operation electrically and mechanically at the time of switching from the voltage control to the current control, and may be set to 20 ms for instance.

Then a step 207 starts the current control using the same electric current as in the normal after-start current. As long as the determination result of the step 202 becomes NO because of the continuation of current control, a step 208 decreases the current control duration timer value CFPI and a step 209 compares the timer value CFPI with 0. With the determination of CFPI>0 indicating that there still remains time, a step 210 continues the current control. With the timer value CFPI=0, the step 209 is followed by a step 211 to read the terminal voltage Vfp of the fuel pump 12. A step 212 calculates the fuel consumption flow amount Qeng by the following equation using the fuel injection duration Ti, engine speed Ne and the conversion constant $\alpha$.

$$Qeng=Ti\times Ne\times\alpha$$

Figure 7:
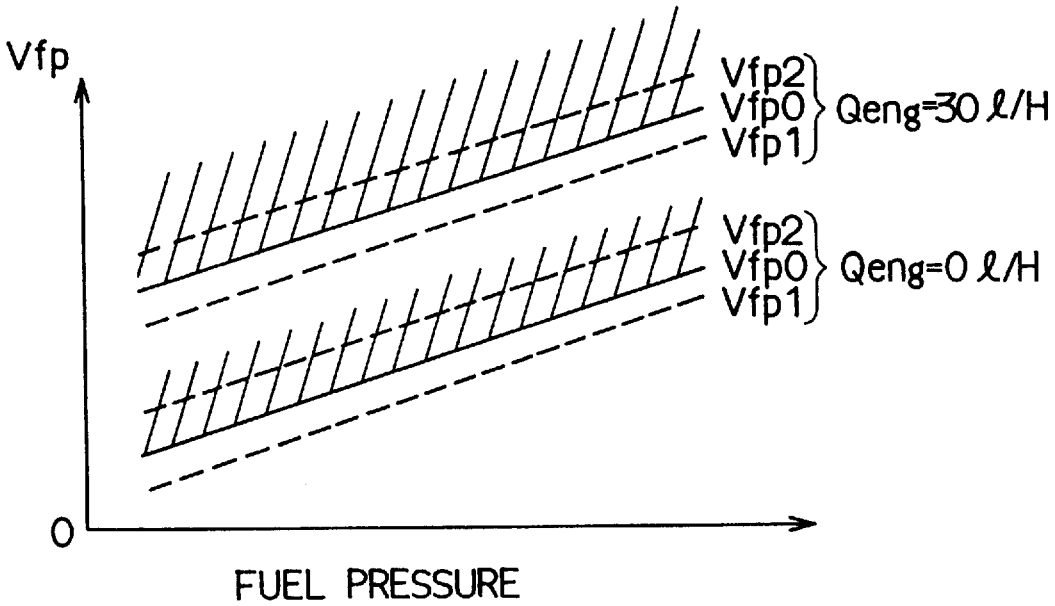
FIG. 7 is a graph illustrating the relationship between fuel pressure and fuel pump speed in the second embodiment.

A step 213 then calculates, as illustrated in FIG. 7, a first predetermined voltage Vfp1 and a second predetermined voltage Vfp2 from the mapped data, i.e., the target fuel pressure Po and the fuel amount Qeng, stored in the ROM of the engine control circuit 20, as Vfp1=f3 (Qeng, Po) and Vfp2=f4 (Qeng, Po). The target fuel pressure Po is the same as the target pressure to which the fuel pressure is controlled by the normal current control during the after-start pump control. The first predetermined voltage Vfp1 is set to determine the timing (equivalent to the pump speed Np1 close to the maximum speed or maximum voltage Vfpo of the range where the fuel can be supplied) for switching from the voltage control to the current control, while the second predetermined voltage is set to determine the timing (equivalent to the pump speed Np2 and slightly higher than the maximum voltage Vfpo) for switching from the current control to the voltage control.

Figure 8:
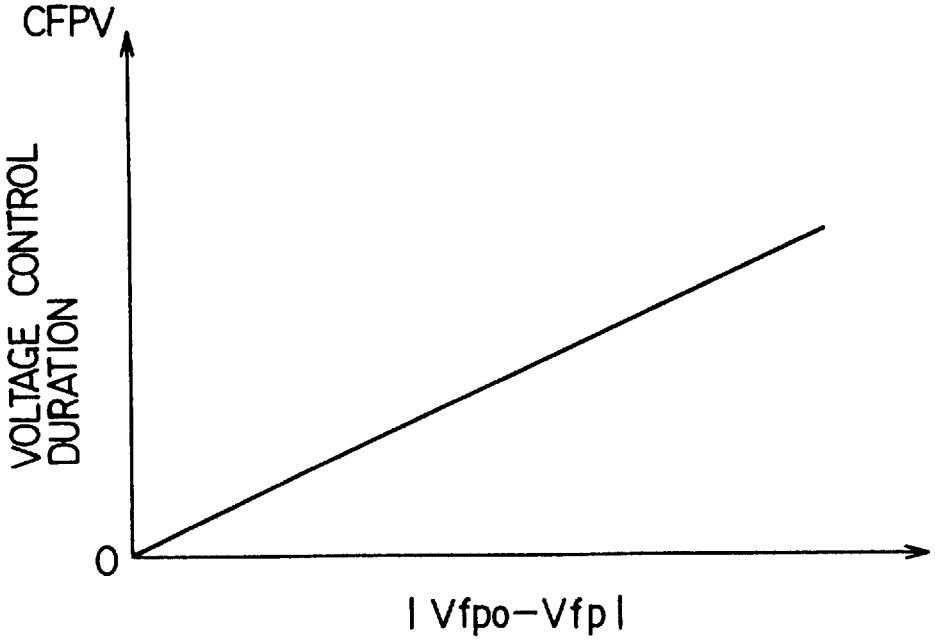
FIG. 8 is a graph illustrating the relationship between voltage difference and voltage control duration in the second embodiment.

Then, a step 214 compares the terminal voltage Vfp read in at the step 211 with the first and the second terminal voltages Vfp1 and Vfp2. Determination of Vfp<Vfp1 means that the pump speed is not high enough to discharge a sufficient amount of fuel, while Vfp>Vfp2 means that the pump speed is high because of the air or fuel vapor remaining in the fuel pipe 15, 17 and the delivery pipe 18. With Vfp being smaller or larger than Vfp1 or Vfp2, respectively, a step 215 follows to set the voltage control duration timer value CFPV for the next voltage control as a function of the terminal voltage of the fuel pump vfp and the target voltage Vfpo, CFPV=f5 (Vfp, Vfpo). The timer value CFPV is determined based on a difference between Vfp and Vfpo. As illustrated in FIG. 8 schematically, the timer value CFPV becomes larger as the difference becomes larger, because the larger difference requires longer time for the terminal voltage Vfp to reach the target voltage Vfpo. After the timer value setting, a step 216 starts to perform the voltage control.

In the event that the terminal voltage Vfp becomes larger or smaller than the predetermined values Vfp1 or Vfp2, respectively, i.e., Vfp1<Vfp<Vfp2, during the voltage control, a step 217 follows from the step 214 to clear the start mode flag and the following step 218 switches the control mode to the normal current control. Thus, the electric current to the fuel pump 12 is decreased in accordance with the duty ratio Dfpc corresponding to the target fuel pressure Po. According to this switching, the fuel pressure overshoot and overrich air/fuel mixture supply which will otherwise be caused by the continuation of the voltage control are suppressed, thereby improving the engine starting operation and exhaust emissions. Once the step 217 cleared the start mode flag, the step 201 provides the determination result of NO and the step 218 continues to perform the normal current control.

Figures 9A, 9B, 9C, 9D:
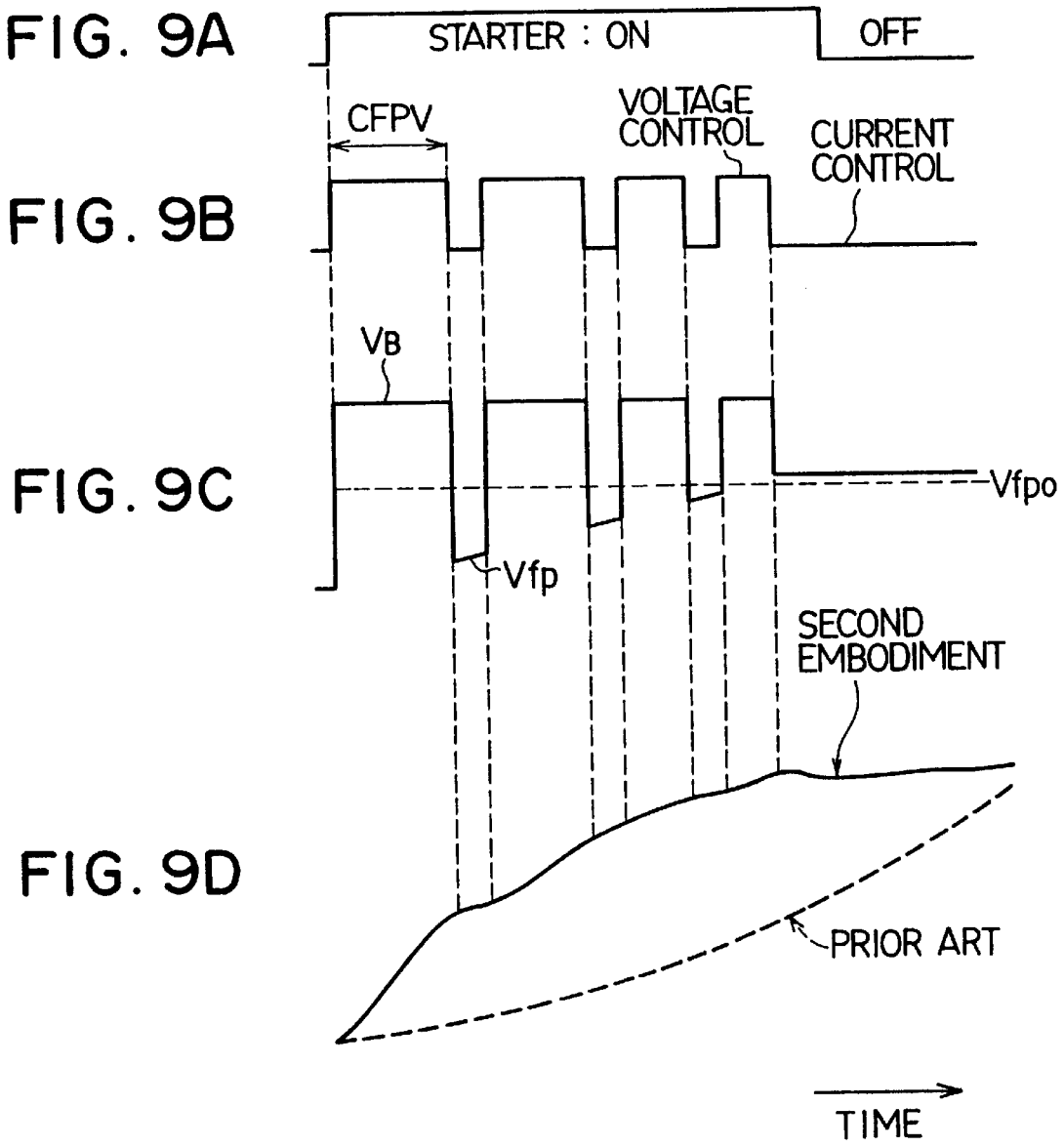
FIG. 9D PRIOR ART
FIGS. 9A–9D are time charts illustrating operational modes of the second embodiment.

According to the second embodiment described above, as soon as a starter is driven for engine starting (FIG. 9A), the voltage control (FIG. 9B) starts to apply the battery voltage VB (FIG. 9C) to the fuel pump 12 so that the pump speed rises and, in response the fuel pressure (FIG. 9D) rises. When the voltage control continues for the duration CFPV, the control is switched from the voltage control to the current control in which the terminal voltage Vfp of the fuel pump 12 is detected to estimate the pump speed and the fuel pressure. If the terminal voltage Vfp is still lower than the first predetermined voltage Vfp1, the control switched to the voltage control again to raise the pump speed and the fuel pressure further. After the continuation of the voltage control for the duration CFPV, the control switches to the current control. The timer value CFPV for each voltage control is set shorter as the difference between the detected terminal voltage Vfp and the target voltage Vfpo becomes smaller, whereby the fuel pressure rises slowly as the fuel pressure approaches the target fuel pressure. Thus, the time interval between the two successive terminal voltage detection is shortened, whereby the fuel pressure is controlled to the target pressure finely. After the terminal voltage Vfp of the fuel pump 12 reaches the first predetermined voltage Vfp1 by the repetition of control mode switching, the fuel pump 12 is controlled solely by the current control. Thus, the voltage control assures a fast build-up of the fuel pressure and the current control assures fuel pressure regulation without use of a fuel pressure sensor.

From the fact that the terminal voltage Vfp of the fuel pump 12 varies with the pump speed, the pump speed can be estimated from the terminal voltage. Therefore, in the event that the terminal voltage Vfp exceeding the first predetermined voltage Vfp1 further rises above the second predtermined voltage Vfp2, it can be estimated that such an excessively high pump speed is caused by the air or vapor entering or remaining in the fuel system. In this instance, the control is switched again to the voltage control until the terminal voltage Vfp falls below the second predtermined voltage Vfp2. During this voltage control, the current control is performed intermittently so that the fuel pressure can be raised to the target pressure accurately and as soon as possible.

In the second embodiment, although the voltage control duration timer value CFPV is variably set in proportion to the difference between the actual terminal voltage Vfp and the target terminal voltage Vfpo of the fuel pump 12, it may be fixed to a constant value.

The present invention having been described should not be restricted to the two preferred embodiments but other embodiments and modifications will be possible to those skilled in the art without departing from the spirit of the invention.

What is claimed is:

1. A fuel supply system for an engine having a fuel tank, comprising:

a fuel pump driven electrically for supplying fuel in the fuel tank to the engine; and a fuel pump control for controlling a rotation speed of the fuel pump thereby to regulate a pressure of the fuel supplied to the engine, said fuel pump control driving the fuel pump at engine starting operation by a generally continuous voltage control and an intermittent current control during the voltage control thereby to detect a terminal voltage of the fuel pump and driving the fuel pump by a generally continuous current control when the detected terminal voltage rises above a first predetermined voltage.

2. The fuel supply system according to claim 1, wherein:

the fuel pump control drives the fuel pump by the voltage control when the detected terminal voltage rises above a second predetermined voltage higher than the first predetermined voltage during the current control thereby to repeat the voltage control with the intermittent current control until the detected terminal voltage falls below the first predetermined voltage.

3. A fuel supply system for an engine having a fuel tank, comprising:

a fuel pump driven electrically for supplying fuel in the fuel tank to the engine; and fuel pump control means for controlling a rotation speed of the fuel pump thereby to regulate a pressure of the fuel supplied to the engine, said control means driving the fuel pump at engine starting operation by a first electric current until the rotation speed of the fuel pump rises to a first predetermined speed and driving the fuel pump after the engine starting by a second electric current which is lower than the first electric current, and wherein the control means drives the fuel pump by an electric current higher than the second electric current when the rotation speed of the fuel pump rises during the engine starting operation above a second predetermined speed higher than the first predetermined speed.

4. The fuel supply system according to claim 3, wherein:

the control means determines the first and the second predetermined speeds in accordance with a fuel flow amount required for consumption by the engine.

5. The fuel supply system according to claim 3, wherein:

the control means determines the first and the second predetermined speeds in accordance with a target pressure of the fuel to be supplied after the engine starting operation.

6. A fuel supply system for an engine having a fuel tank, comprising:

a fuel pump driven electrically for supplying fuel in the fuel tank to the engine; and fuel pump control means for controlling a rotation speed of the fuel pump thereby to regulate a pressure of the fuel supplied to the engine, said control means driving the fuel pump at engine starting operation by a generally continuous voltage control and an intermittent current control during the voltage control thereby to detect a terminal voltage of the fuel pump and driving the fuel pump by a generally continuous current control when the detected terminal voltage rises above a first predetermined voltage.

7. The fuel supply system according to claim 6, wherein:

the control means applies a battery voltage to the fuel pump during the voltage control.

8. The fuel supply system according to claim 7, wherein:

the control means drives the fuel pump by the voltage control when the detected terminal voltage rises above a second predtermined voltage higher than the first predetermined voltage during the current control thereby to repeat the voltage control with the intermittent current control until the detected terminal voltage falls below the first predetermined voltage.

9. The fuel supply system according to claim 8, wherein:

the control means determines the first and the second predetermined voltages in accordance with a fuel flow amount required for consumption by the engine.

10. The fuel supply system according to claim 8, wherein:

the control means determines the first and the second predetermined voltages in accordance with a target pressure of the fuel to be supplied after the engine starting operation.

11. The fuel supply system according to claim 6, wherein:

the control means repeats the intermittent current control at every time interval which is shortened as a difference of the detected terminal voltage and the target voltage is shortened.

* * * * *